US007681755B2

(12) United States Patent
Roesler

(10) Patent No.: US 7,681,755 B2
(45) Date of Patent: Mar. 23, 2010

(54) CONTAINER WITH SNAP-IN CLOSURE

(76) Inventor: Peter Roesler, Ifenweg 3, D-88239 Wangen/Allgau (DE)

( * ) Notice: Subject to any disclaimer, the term of this patent is extended or adjusted under 35 U.S.C. 154(b) by 479 days.

(21) Appl. No.: 11/382,735

(22) Filed: May 11, 2006

(65) Prior Publication Data

US 2007/0095838 A1 May 3, 2007

(30) Foreign Application Priority Data

May 13, 2005 (DE) ..... 20 2005 007 586 U

(51) Int. Cl.

| | |
|---|---|
| ***B65D 41/16*** | (2006.01) |
| ***B65D 39/00*** | (2006.01) |
| ***B65D 41/18*** | (2006.01) |
| ***A45C 13/10*** | (2006.01) |
| ***A45C 13/18*** | (2006.01) |
| ***E05C 19/10*** | (2006.01) |
| ***E05C 9/00*** | (2006.01) |
| ***E05C 19/06*** | (2006.01) |
| ***E05C 19/00*** | (2006.01) |

(52) U.S. Cl. ..... 220/788; 220/786; 220/787; 220/780; 206/1.5; 206/806; 292/28; 292/81; 292/300; 292/303

(58) Field of Classification Search ..... 220/788, 220/523, 203.17, 787, 786; 292/28, 80, 81, 292/84, 86, 89, 303; 206/1.5, 806
See application file for complete search history.

(56) References Cited

U.S. PATENT DOCUMENTS

| | | | | |
|---|---|---|---|---|
| 3,023,925 | A * | 3/1962 | Sher | 220/786 |
| 3,335,774 | A * | 8/1967 | Reed | 220/790 |
| 4,049,357 | A * | 9/1977 | Hamisch, Jr. | 403/209 |
| 4,582,219 | A * | 4/1986 | Mortensen et al. | 220/326 |
| 5,375,708 | A * | 12/1994 | Wittman | 206/315.1 |
| 6,102,236 | A * | 8/2000 | Ohlsson et al. | 220/254.1 |
| 6,305,725 | B1 * | 10/2001 | Antonucci et al. | 292/67 |
| 6,588,616 | B1 * | 7/2003 | Ho | 220/4.03 |
| 7,296,730 | B2 * | 11/2007 | Erdie | 229/125.17 |
| 2003/0029756 | A1 * | 2/2003 | Vasudeva et al. | 206/379 |

* cited by examiner

*Primary Examiner*—Anthony Stashick
*Assistant Examiner*—Andrew T Kirsch
(74) *Attorney, Agent, or Firm*—Frederick L. Tolhurst, Esq.; Cohen & Grigsby, P.C.

(57) ABSTRACT

A container comprising a snap-in closure disposed between an upper part and a lower part of the container, the snap-in closure having a relatively strong holding or locking force and able to be opened relatively easily. The snap-in closure comprises a snap-in tab constructed out of the wall of one part of the container and detached along three sides, with a snap-in key disposed at the upper free end of the said snap-in closure and able to engage in a coordinated snap-in slit at the opposite container part.

10 Claims, 3 Drawing Sheets

CONTAINER WITH SNAP-IN CLOSURE

CLAIM OF PRIORITY

This invention claims the benefit of German Application No. 20 2005 007 586.8, filed on May 13, 2005.

FIELD OF THE INVENTION

The claimed invention is a container comprising a snap-in closure disposed between an upper and a lower part, and specifically a container wherein the snap-in closure has a relatively strong locking force and is able to be opened easily.

BACKGROUND OF THE INVENTION

Containers having snap-in closures are known to the art in various embodiments. For example, it is known in the art to dispose a snap-in closure between an upper part and a lower part of a container, where the snap-in closure is constructed as knob closure. Such a closure, although easy to open, has a very weak holding or locking force. In order to store relatively heavy objects in a container, however, it is necessary to provide a snap-in closure that has a strong holding force and that facilitates construction at relatively low manufacturing costs.

SUMMARY OF THE INVENTION

It is therefore an object of the claimed invention to disclose a container comprising a snap-in closure of the aforementioned type in such a way that the snap-in closure offers a strong holding force combined with low cost and good operability.

The claimed invention achieves this objective. The claimed container comprises a snap-in closure disposed between an upper part and a lower part. The snap-in closure comprises a snap-in tab disposed in or constructed out of a wall of the one parts and detached along three sides, and having a snap-in key disposed on the upper free end thereof. The snap-in closure further comprises a corresponding snap-in slit in the opposite container part into which the snap-in key is able to snap.

Based on the enabling disclosure, the substantial advantage of the claimed invention is that a snap-in tab is formed out of and/or detached from the wall of one container part. A substantially high spring force is generated by the snap-in tab since normally containers of this type have a wall thickness of about 0.5 to 2.0 mm and very high closure forces can be generated with the selection of a suitable synthetic material. The detachment of the snap-in tab from the wall of one container part provides a good spring action that can be effected for the snap-in tab. The snap-in force of the snap-in tab is determined during manufacture and is related to the length of the detachment. In an example, a snap-in key is disposed at the upper free end of the snap-in tab. Sharp-edged surfaces of the snap-in tab can engage a coordinated snap-in slit on the opposite container part. The opposing sharp-edged surfaces result in the generation of high snap-in forces that are able to withstand even the corresponding opening forces acting on the container parts.

An initial, preferred embodiment provides that a snap-in tab be disposed directly in the wall in the container part and can thus be pivoted into the interior space of the one container, in order to operate the snap-in closure.

A second embodiment, on the other hand, provides that the snap-in tab be disposed in the container wall of the one container part, but that the snap-in tab cannot be pivoted into the interior of the container, because the interior space is separated from the snap-in tab by an additional interior wall.

The subject of the present invention does not ensue only from the subject of the individual claims, but also from the combination of the individual claims. All information and features disclosed in the documentation, including in the abstract, in particular, the spatial structure shown in the drawings, are claimed as substantial to the invention insofar as they are novel individually or in combination in relation to the prior art. The innovation is described in more detail below with reference to drawings showing several embodiments. In this context, further features and advantages of substantial significance to the invention ensue from the drawings.

DETAILED DESCRIPTION

Figure 1:
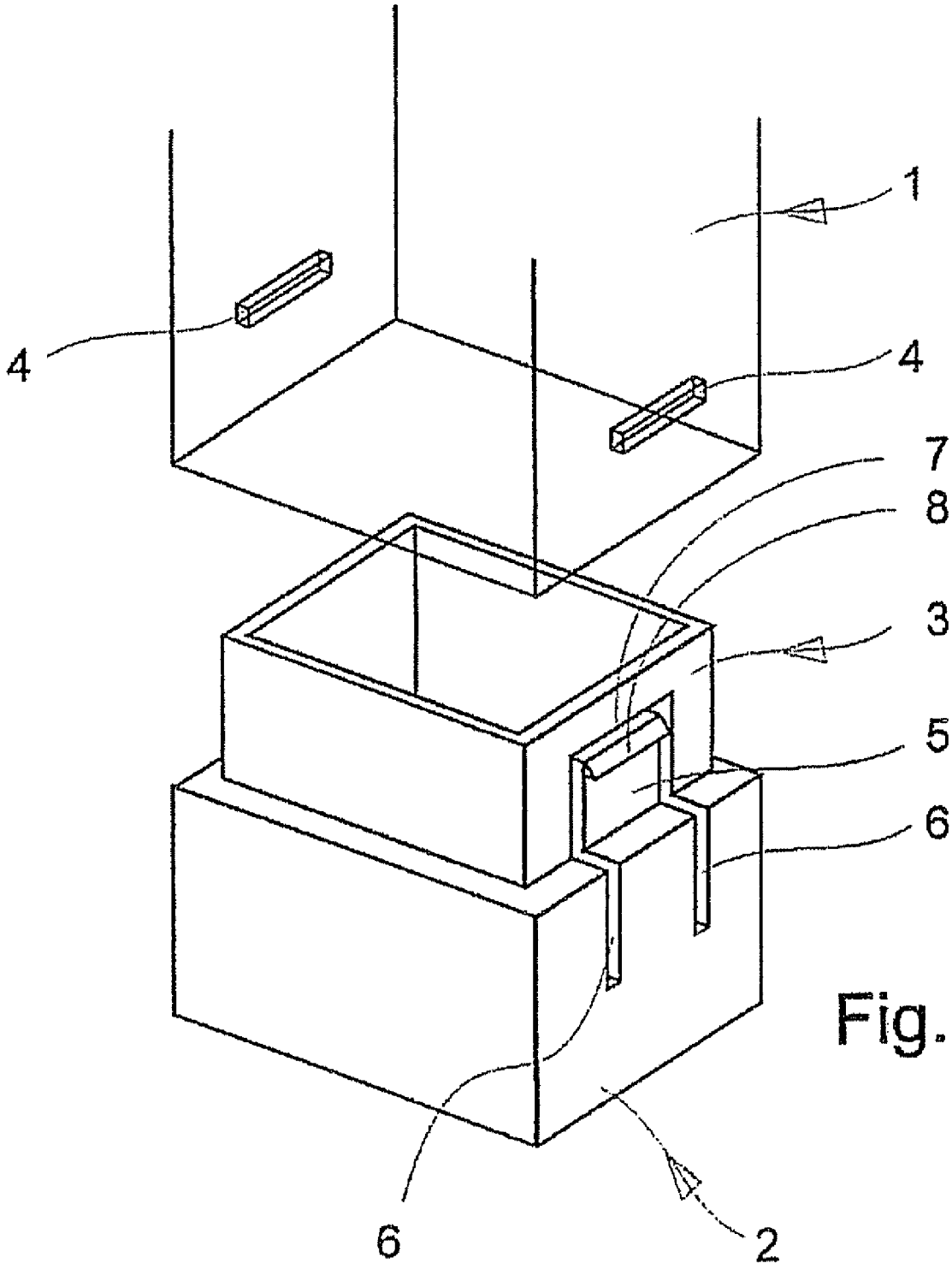
FIG. 1 shows a schematic representation of a perspective view of an example of an embodiment of the claimed container in the open state.
Figures 2, 3:
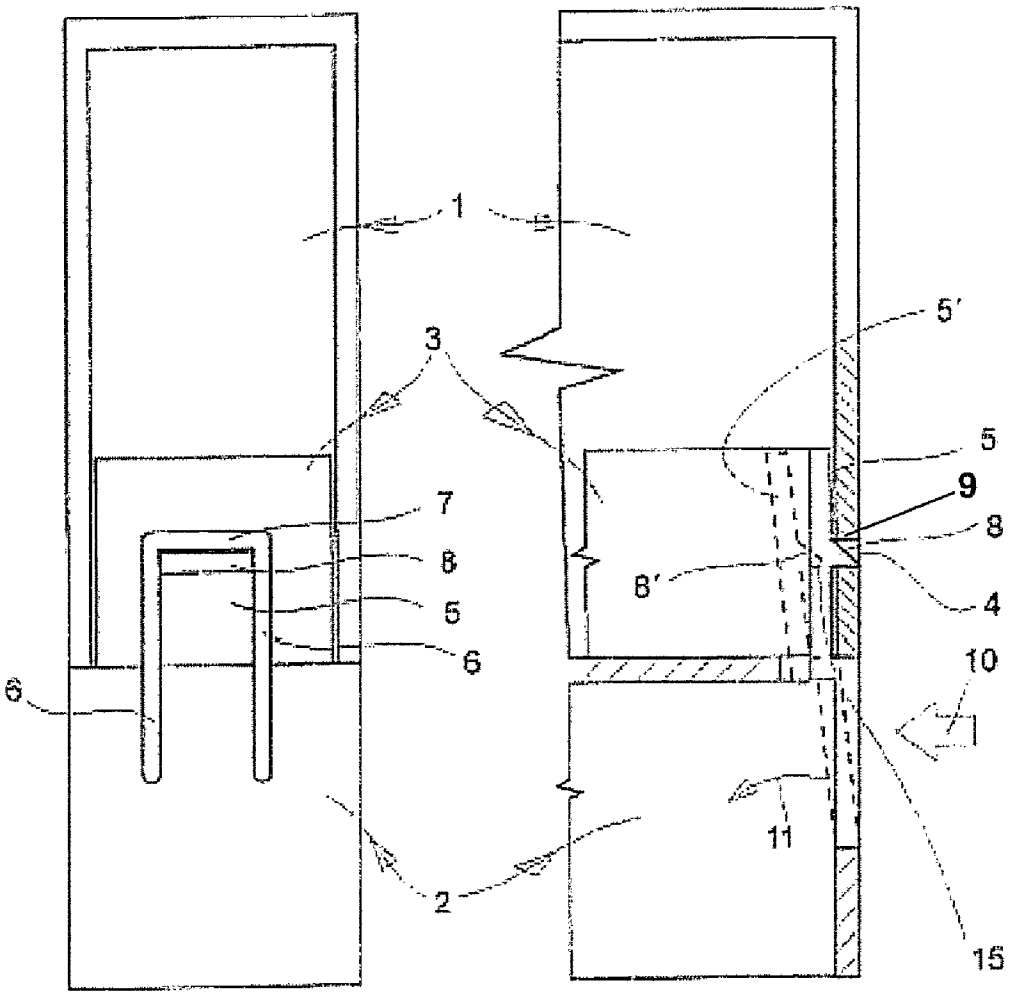
FIG. 2 shows a cross-sectional view of an example of the claimed container in the closed state, cut through the lateral wall comprising the claimed snap-in closure.
FIG. 3 shows a lateral view of the example of the claimed invention shown in FIG. 2.

The container according to FIGS. 1 through 3 comprises an upper part 1 and a lower part 2 that snaps into the upper part 1. The two parts 1, 2 may be constructed of any desired material composition, such as for example, metal, synthetic materials, composite materials, and other similar materials. The two parts 1, 2 may be constructed as transparent, partially transparent, or not transparent. The terms "upper part" and "lower part" are interchangeable. It is therefore not important in which part 1, 2 the snap-in closure with the snap-in device 5, described below, is constructed. In the example of an embodiment shown in FIG. 1, the snap-in closure is disposed in or constructed out of a wall of the lower part 2 of the container. It is also advantageous that the lower part 2 of the container comprises a lower part of greater dimensions changing into an upper socket-type part 3 having smaller dimensions and being open on top. The construction of the snap-in device in the area of the socket-type part 3 has the advantage that, according to FIG. 2, the container walls of the upper and the lower parts 1, 2 fit flush one into the other.

In order to produce a snap-in tab 5, it is detached on three sides. In the wall of the lower part 2 and the socket-type part 3, the longitudinal slits 6 are disposed in parallel and at a distance from one another, thus perforating the walls of parts 2, 3. In the socket-type part 3, the longitudinal slits 6 are connected by a crosscut 7 so that an approximately U-shaped slit-like perforation is created in the wall of the socket-type part 3 and lower part 2. Thereby, a snap-in tab 5 is generated with its upper free end freely pivotable, and depending at least in part on the material strength or flexibility of the material used. As shown in FIG. 2, the snap-in tab 5 thus can be pivoted in the direction of the arrow 11 against the spring force of the wall of the material in order to cause the snap-in closure to disengage.

A snap-in key 8 equipped with an upper sharp edge 15 and a lower slant 9 is disposed at the free upper end of the snap-in tab 5. The aforementioned snap-in key 8 can be snapped in at a corresponding snap-in slit 4 having relatively sharp lateral edges. This generates extraordinarily high holding forces.

The wall material of the lower part 2, 3 is relatively large so that it is difficult to cause the container, once snapped in, to open without opening the snap-in closure. However, only substantially low forces are needed to press snap-in tab 5 in the direction of arrow 10 because the length of the snap-in tab 5 can be made relatively long in order to achieve a good spring action.

Figure 4:
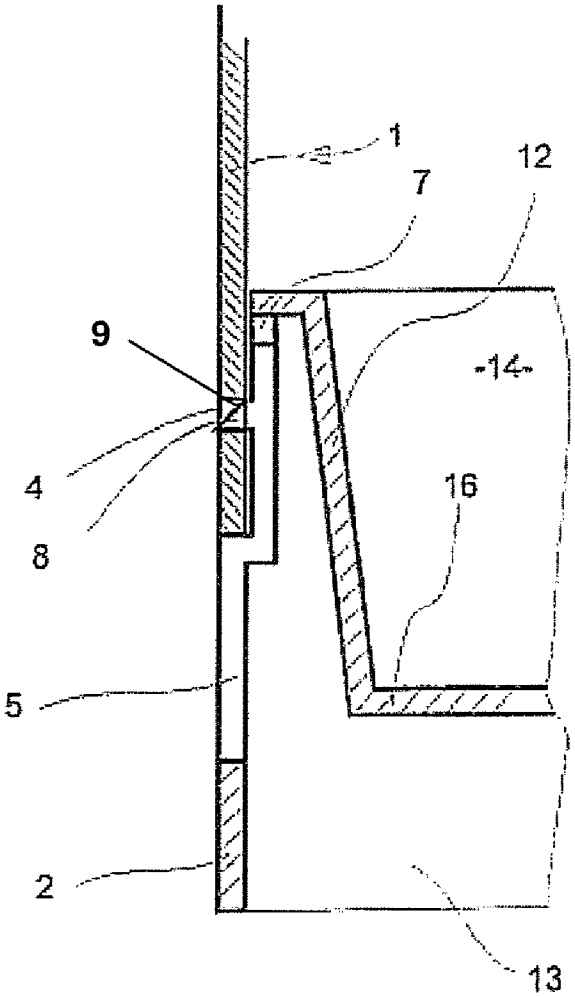
FIG. 4 shows a partial cross-sectional view of an example of an alternate embodiment of the claimed invention.

FIG. 4 shows an example of an alternate embodiment of the claimed invention, wherein the lower part 2 is equipped with a lower opening 13 and an interior bottom 16. The formed interior space 14 is formed by the surrounding interior walls 12 and the bottom 16 terminating the interior walls. The snap-in closure is disposed outside of the interior space 14 of the lower part 2 in order to thereby completely insulate the interior space 14 against effects from the outside. In the closed state, therefore, no dirt can reach the interior space 14 through the snap-in closure.

While the foregoing has been set forth in considerable detail, it is to be understood that the drawings, detailed embodiments, and examples are presented for elucidation and not limitation. Design variations, especially in matters of shape, size, and arrangements of parts, may be made but are within the principles of the invention. Those skilled in the art will realize that such changes or modifications of the invention or combinations of elements, variations, equivalents, or improvements therein are still within the scope of the invention as defined in the appended claims.

LIST OF REFERENCE CHARACTERS

1 upper part
2 lower part
3 socket-type part
4 snap-in slit
5 snap-in tab
6 longitudinal slit
7 cross-slit
8 snap-in key
9 slant
10 direction of arrow
11 direction of arrow
12 interior wall
13 opening
14 interior space
15 cover surface
16 bottom

I claim:

1. A container comprising:

a first part:

a second part that is oppositely located from said first part, said second part including a socket-type part that is receivable in said first part, said socket-type part having a smaller dimension than the rest of said second part so that, at times when the socket-type part is received in said first part, the walls of the first part are flush with the walls of said rest of said second part; and a snap-in closure that is disposed between said first part and said second part, said snap-in closure including;

a. a snap-in tab that is defined by two slots in a wall of said second part, said slots being longitudinally aligned with said second part, said slots being partially located in said rest of said second part and extending into the smaller dimensioned socket-type part, said snap-in tab being further defined by a cross-cut slot in said socket-type part, said cross-cut slot connecting said longitudinal slots and passing between the snap-in tab and the free end of the smaller dimensioned socket-type part so that the portion of said snap-in tab in said socket-type part is shorter than the smaller dimensioned socket-type part and is detached from the smaller dimensioned socket-type part along three sides of the snap-in tab, said snap-in tab having a key that is disposed on the free end of said snap-in tab, said snap-in tab being pivoted toward the interior of said second part in response to manually pressing the portion of said snap-in tab in said rest of said second part toward the interior of said second part; and b. a snap-in slit that is configured in said first part at a location corresponding to the key of said snap-in tab at times when said socket-type part is received—in said first part allowing said key to snap into said slit, said snap-in closure being released by pressing the portion of said snap-in tab in said rest of second part toward the interior of said second part to pivot said snap-in tab toward the interior of said second part to withdraw the key of said snap-in tab from said snap-in slit.

2. A container according to claim 1, wherein said snap-in tab is off-set according to the difference in the dimension of said socket-type part and the dimension of said rest of said second part, said free end of said snap-in tab being freely pivotal and having a relatively high spring force.

3. A container according to claim 1, wherein the spring action of said snap-in tab is proportional to the length of said detachment of said snap-in tab and the adjustable snap-in force of said snap-in tab.

4. A container according to claim 1, wherein said snap-in key has sharp-edged surfaces that engage with said corresponding snap-in slit on said first part.

5. A container according to claim 4, wherein said sharp-edged surfaces provide said snap-in closure with a relatively high snap-in force that can withstand opening forces of said snap-in closure.

6. A container according to claim 1 wherein said second part includes an interior wall that defines an interior space in said second part, said interior wall isolating said snap-in tab from said interior space of said second part.

7. A container according to claim 1 wherein said snap-in tab is constructed from a synthetic material and generates relatively high closing forces.

8. A container according to claim 1 wherein said second part is an upper part and said first part is a lower part.

9. A container according to claim 1 wherein said second part is a lower part and said first part is an upper part.

10. A container according to claim 1 wherein said second part of said container comprises a lower part and an upper socket-type part that has dimensions that are smaller than said lower part and that also has an open top.

* * * * *